US010682695B2

(12) United States Patent
Goettsch et al.

(10) Patent No.: US 10,682,695 B2
(45) Date of Patent: Jun. 16, 2020

(54) METHOD FOR THE SEMI-PERMANENT MOLD CASTING PROCESS

(71) Applicant: GM Global Technology Operations LLC, Detroit, MI (US)

(72) Inventors: David D. Goettsch, Shelby Township, MI (US); Allen Birschbach, Grand Blanc, MI (US); Mark Eugene Hoover, Mount Morris, MI (US); Kyle W. Lehrmann, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/972,503

(22) Filed: May 7, 2018

(65) Prior Publication Data

US 2019/0337049 A1 Nov. 7, 2019

(51) Int. Cl.

| | |
|---|---|
| ***B22D 27/04*** | (2006.01) |
| ***B22C 9/06*** | (2006.01) |
| ***B22C 9/08*** | (2006.01) |

(52) U.S. Cl.

CPC ..... *B22D 27/04* (2013.01); *B22C 9/068* (2013.01); *B22C 9/088* (2013.01)

(58) Field of Classification Search

CPC ..... B22C 9/065; B22C 9/068; B22C 9/082; B22C 9/088; B22D 27/04; B22D 27/00

See application file for complete search history.

(56) References Cited

U.S. PATENT DOCUMENTS

| | | | | |
|---|---|---|---|---|
| 8,522,857 | B2 | 9/2013 | Goettsch et al. | |
| 2011/0114280 | A1* | 5/2011 | Iwasa | B22D 23/006 164/121 |

* cited by examiner

*Primary Examiner* — Kevin P Kerns
*Assistant Examiner* — Steven S Ha

(57) ABSTRACT

A method for casting metal using a semi-permanent mold connected to a feed portion includes forming a coolant jacket in a sprue of the feed portion. A coolant source is connected to the coolant jacket. A metal in a molten state is poured into the feed portion for gravity induced flow into the semi-permanent mold. A wall thickness of the sprue is predetermining which minimizes heat transfer from the sprue, thereby forcing the metal in the molten state to cool slower in the sprue than in the mold. After a predetermined time for the metal to cool to a solid state in the mold, flow of a coolant from the coolant source into the coolant jacket is initiated to cool the metal in the sprue before opening the mold.

8 Claims, 5 Drawing Sheets

METHOD FOR THE SEMI-PERMANENT MOLD CASTING PROCESS

The present disclosure relates to molding for metal cast components including automobile vehicle engine components.

Components such as cylinder heads for automobile vehicle engines are commonly cast using a semi-permanent mold which is filled with molten metal such as aluminum and gravity fed into the mold. A semi-permanent mold (SPM) involves a casting process, which may produce aluminum alloy castings from re-usable metal molds and sand cores to form internal passages within the resulting casting. SPM cylinder head molds are composed of multiple horizontal side slide mold components (3 or 4) that lay above a base mold component. The SPM is commonly arranged in two halves, with the sand cores being put into place before the two mold halves are placed together. Following molten metal pour the material cools and contracts within the mold, with up to approximately 7% contraction being common. To accommodate contraction, an overfill volume of molten metal is added, with a portion of the overfill volume allowed to push out of the mold, creating a riser.

After the material cools for a minimum time to solidify and allow the mold to be opened, normally about 240 seconds, the overfill material of the riser must then be removed by a subsequent machining operation and re-melted for reuse. Due to contraction and the time required to cool all of the material, an average time required to fill the mold is approximately 20 to 25 seconds. A typical metal yield for a cylinder head casting is approximately 50% because of the colder riser arrangement. Such a poor yield limits castline cycle times. The molding costs associated with known semi-permanent mold operations are also impacted by the amount of additional material required to be melted, the time required to allow all of the material including the riser to cool before the mold can be opened, and the machining time and costs to remove the riser material.

Thus, while current semi-permanent mold processes achieve their intended purpose, there is a need for a new and improved system and method for molding metal components using a semi-permanent mold.

SUMMARY

According to several aspects, a method for casting metal using a semi-permanent mold connected to a gating section and a feed portion includes: connecting the gating section for fluid communication with the semi-permanent mold; incorporating a force cooled sprue in the feed portion; pouring a metal in a molten state into the feed portion for gravity induced flow into each of the gating section and the semi-permanent mold; and during a predetermined time for the metal to cool to a solid state in the mold, initiating flow of a coolant into the sprue to cool the metal in the sprue before opening the mold.

In another aspect of the present disclosure the method includes: controlling the semi-permanent mold to approximately 300 degrees or greater Centigrade prior to the pouring step; and continuing the flow of the coolant or use of a heater until the mold which forms the sprue is approximately 300 degrees Centigrade.

In another aspect of the present disclosure, the method includes providing a choke point in the sprue to predetermine a fill time of the mold of approximately 11 seconds.

In another aspect of the present disclosure, the method includes continuing the flow of the coolant for approximately 20 seconds prior to opening the mold, and cooling the sprue so it is solid at a 240 second mold open time.

In another aspect of the present disclosure, the method includes providing a predetermined wall thickness in the sprue in a shell between the coolant jacket and a passageway of the sprue, the passageway providing for through flow of the metal in the molten state, the predetermined wall thickness ranging between a minimum wall thickness and a maximum wall thickness.

In another aspect of the present disclosure, the method includes selecting the minimum wall thickness as 3 mm to prevent solidification from occurring too slowly, defined as exceeding 240 seconds as the predetermined time for the metal to cool to a solid state in the mold.

In another aspect of the present disclosure, the method includes selecting the maximum wall thickness as 6 mm to prevent solidification from occurring too quickly, defined as solidification of the metal in the mold occurring prior to solidification of the metal in the feed portion.

In another aspect of the present disclosure, the method includes: preforming a coolant jacket in the sprue about a shell; and connecting a coolant source to the coolant jacket.

In another aspect of the present disclosure, the method includes extending the coolant jacket for a substantial length of the sprue and gating.

In another aspect of the present disclosure, the method includes: connecting the coolant source to an input connection of the coolant jacket; and fixing an output connection of the coolant jacket to a coolant return line to return the coolant to the coolant source.

According to several aspects, a method for casting metal using a semi-permanent mold connected to a feed portion includes: forming a coolant jacket in a sprue of the feed portion; connecting a coolant source to the coolant jacket; pouring a metal in a molten state into the feed portion for flow into the semi-permanent mold; predetermining a wall thickness of the sprue to minimize heat transfer, thereby forcing the metal in the molten state to cool slower in the sprue than in the mold; and during a predetermined time for the metal to cool to a solid state in the mold, initiating flow of a coolant from the coolant source into the coolant jacket to cool the metal in the sprue before opening the mold.

In another aspect of the present disclosure, the method includes joining a gating section for fluid communication with the semi-permanent mold with the gating section positioned between the sprue and the mold.

In another aspect of the present disclosure, the method includes: selecting approximately 240 seconds as the predetermined time for the metal to cool to the solid state in the mold; and continuing the flow of the coolant until the metal in the sprue cools to approximately 450 degrees Centigrade.

In another aspect of the present disclosure, the method includes limiting the continuing step to a time period of approximately 20 seconds.

In another aspect of the present disclosure, the method includes orienting the feed portion to enable gravity induced flow through the feed portion.

In another aspect of the present disclosure, the method includes providing the sprue as a first half releasably connected to a second half, the first half and the second half when connected defining a passageway for flow of the metal in the molten state.

In another aspect of the present disclosure, the method includes providing a choke point in the passageway to control a mass flow rate of the metal in the molten state and to provide a mold fill time of approximately 11 seconds.

According to several aspects, a system for casting metal using a semi-permanent mold includes a semi-permanent mold receiving a metal in a molten state. A gating section is in communication with the mold. A feed portion communicates with the gating section, the feed portion including a sprue. A coolant jacket is incorporated in the sprue. The coolant jacket is in communication with a coolant source to positively cool the metal in the sprue after a predetermined time for the metal to cool to a solid state in the mold.

In another aspect of the present disclosure, the sprue includes a choke point sized to restrict flow of the metal in the molten state to ensure the sprue defines a final location where the metal cools to a solid state.

In another aspect of the present disclosure, the feed portion further includes: a pour basin receiving a predetermined volume of the metal in the molten state; and a horizontally oriented runner in communication with the sprue and with the gating section, the runner receiving the molten metal from the sprue for transfer to the gating section from which the metal flows into the mold.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
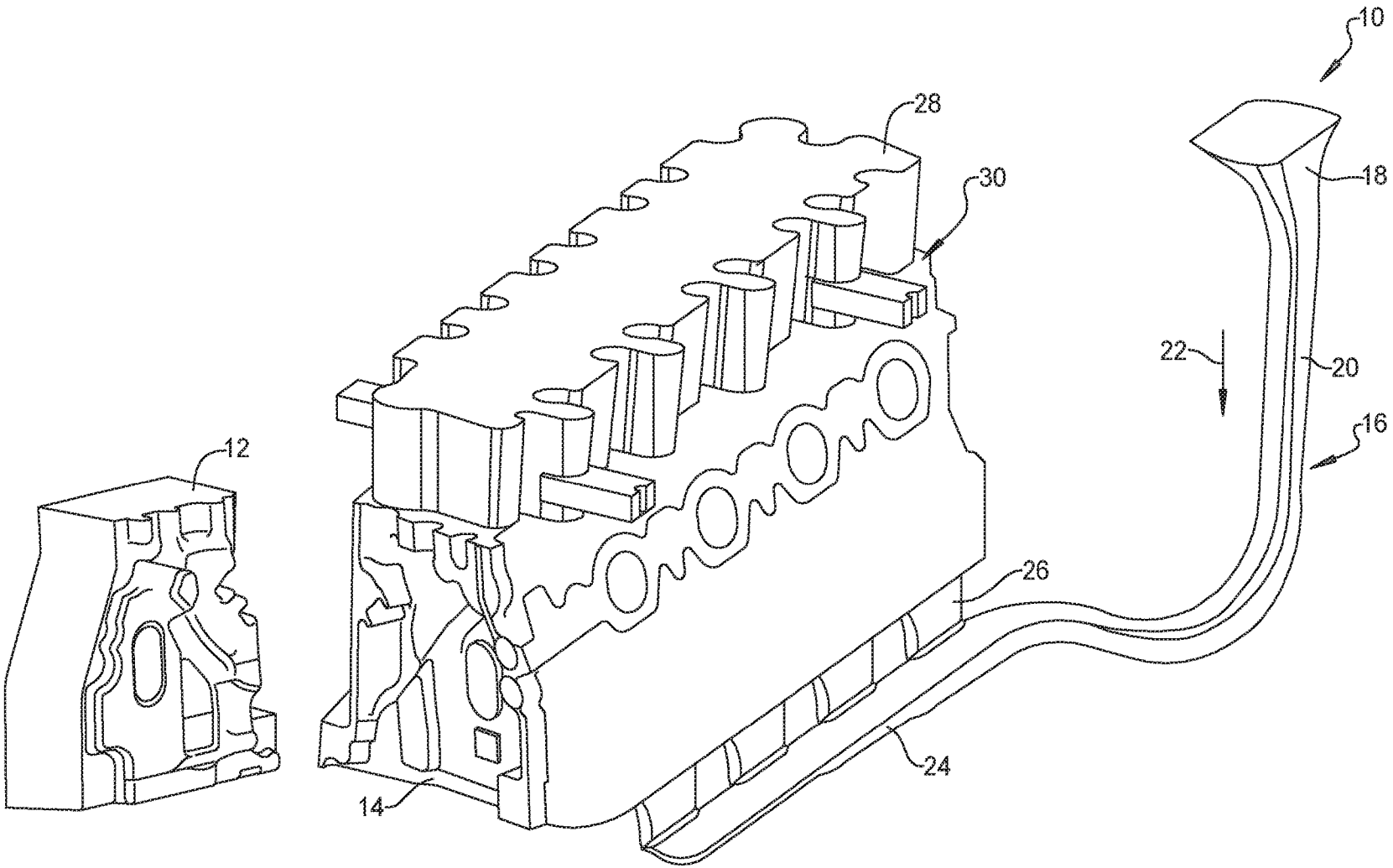
FIG. 1 PRIOR ART
FIG. 1 is a front left perspective view of a known semi-permanent mold system used for casting aluminum cylinder heads.

Referring to FIG. 1, a known system 10 is presented which uses a semi-permanent mold 12, an end portion of which is shown, to produce a casting 14 such as an aluminum cylinder head for an automobile vehicle internal combustion engine (not shown). Molten aluminum material is gravity fed into the semi-permanent mold 12 via a feed portion 16. The feed portion 16 defines a gating system which includes a pour basin 18 acting similar to a funnel into which the molten metal is poured. The material flows downward out of the pour basin 18 through a sprue 20 in a downward direction 22 and transitions into a generally horizontally oriented runner 24. From the runner 24, the material flows through multiple gates 26 into the mold 12.

As the molten metal fills the mold 12, to force a volume of the casting metal which may contain porosity away from the finished casting, an overflow of the molten metal creates a riser 28 generally above the mold 12, where cooling is slowest, and therefore where porosity may most likely occur. Due to expected contraction of the molten metal during cooling, the size and volume of the riser 28 are predetermined to calculate a total volume of molten metal to be added to the pour basin 18 and/or the sprue. To ensure gravity flow, an elevation of the pour basin 18 must be predetermined to position the pour basin 18 at or above a maximum expected height of the riser 28. The sprue 20 and the runner 24 are sized to permit flow relying only on gravity, a mold fill time of approximately 20 to 22 seconds, and a cooling/casting removal period of approximately 240 seconds. The volume of metal flushed through the mold 12 to create the casting 14 and the riser 28 create a poor temperature gradient for solidification and poor metal yields. In addition, after the material in the mold 12 and the riser 28 cools sufficiently to allow the mold 12 to be opened and the casting 14 to be removed, the riser 28 must be subsequently removed, for example by a machining operation. The machining operation removes the riser 28, leaving a machined upper surface 30 of the casting 14.

Referring to FIG. 2 and again to FIG. 1, a molding system 34 according to the present disclosure uses a semi-permanent mold 36, an end portion of which is shown, to produce a casting 38 such as an aluminum cylinder head for an automobile vehicle internal combustion engine (not shown). A metal in a molten state such as molten aluminum alloy is gravity fed into the semi-permanent mold 36 via a feed portion 40, which is modified from the feed portion 16 discussed in reference to FIG. 1. The feed portion 40 includes a pour basin 42 functioning similar to the pour basin 18 into which the molten metal is poured, however the pour basin 42 can be sized for a smaller volume of molten metal than the pour basin 18 because a riser is not produced in the process of the molding system 34, therefore an overfill volume to produce the riser is not required to be added.

The feed portion 40 also includes a force cooled sprue 44. The molten metal flows downward out of the pour basin 42 through the sprue 44 in a downward direction 46 aided by gravity, and transitions into a generally horizontally oriented runner 48 which communicates with and directs the molten metal into a gating section 50, from which the molten metal flows upwardly into the mold 36. Because the casting process for the molding system 34 does not produce a riser which requires significant fill and cooling time, improved thermal management during mold fill allows directional solidification of the molten metal from the molten state to a solid state back into the gating section 50, the runner 48 and the sprue 44. A flow choke point 52 is also provided in the feed portion 40 which predetermines a feed rate of the molten metal into the mold 36. Molten metal head pressure is maintained in the sprue 44 and the runner 48 by the choke point 52. The material thicknesses selected for the sprue 44 and the gating section 50 control heat transfer such that the sprue 44 and the gating section 50 heat up rapidly during mold fill. This extends the solidification time for the gating section 50 and the sprue 44 beyond a solidification time for the casting 38. The sprue 44 and the gating section 50 will therefore act as the final location in the molding system 34 where the metal converts by cooling from the molten state to the solid state.

Stagnant air insulates the thin walled mold in the area of the runner 48 and the sprue 44 during mold fill and casting solidification. Because of the stagnant air and a reduced volume and wall thickness of the mold forming the gating section 50, the runner 48 and the sprue 44, a slower cooling time is provided in the gating section 50, the runner 48 and the sprue 44. The material in the feed portion 40 will therefore be the last material to fully solidify and cool. To accelerate solidification of molten metal in the gating section 50, the runner 48 and the sprue 44, and thereby to allow earlier casting ejection, a coolant flush of the sprue 44 is conducted after a predetermined time period has elapsed allowing casting solidification in the gating section 50. To provide for coolant flush, the sprue 44 is connected to a coolant source 54 via a coolant supply line 56 and a coolant return line 58. Providing coolant flow to the sprue 44 allows the casting material to directionally solidify toward the gating section 50.

The mold 36 is controlled to approximately 300 degrees or greater Centigrade by a separate mold cooling and heating system (not shown). If there is a cycle interruption, the mold will cool below the minimum 300 degrees Centigrade requirement, therefore under these conditions the heating system provides additional heat for the sprue 44 to reach its minimum solidification time. For an exemplary aluminum alloy material, the molten pour material is preheated to approximately 720 degrees Centigrade, therefore molten metal cooling begins immediately during the pour. A time of approximately 10 to 11 seconds is required to gravity fill the mold 36. After mold fill, the molten metal cools to a typical solidification stage temperature of approximately 600 degrees Centigrade and is allowed to cool for a time period of approximately 240 seconds. Because the molding system 34 is designed to have the material of the gating section 50, the runner 48 and the sprue 44 be the last to cool to the solid stage, to ensure the material of the gating section 50, the runner 48 and the sprue 44 have cooled sufficiently to allow the mold 36 to be opened, the coolant flush of the sprue 44 is conducted at or near the end of the 240 second cooling period. The coolant provided by the coolant source 54 is preferably air but also can be water, which cools the metal in the feed portion 40 including the sprue 44 from the typical solidification stage temperature of approximately 600 degrees Centigrade down to approximately 450 degrees Centigrade. A sprue metal temperature of 450 degrees Centigrade is sufficient for the mold to open and the sprue 44 to stay in place for extraction. The sprue mold coolant is therefore turned off when the metal has reached 450 degrees Centigrade.

A typical molten metal pour weight of approximately 50 pounds will produce an aluminum cylinder head weighing approximately 25 pounds. Additional material therefore remains in the molding system 34 after the casting 38 is removed. Material remaining in the mold 36, flashing on the casting 38, and all of the material in the feed portion 40 after cooling is removed and reused.

Figure 2:
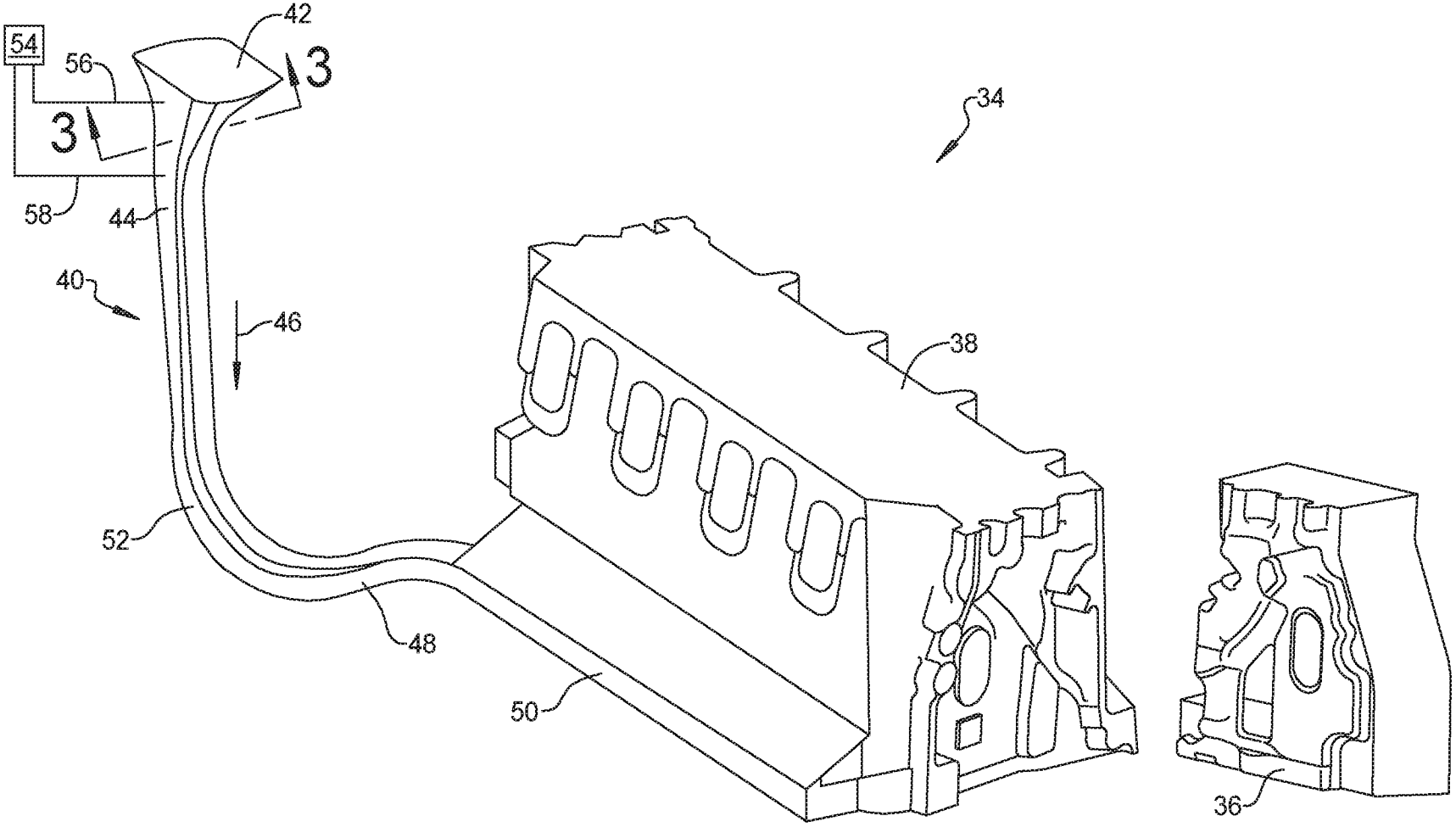
FIG. 2 is a front right perspective view of a semi-permanent mold system according to an exemplary embodiment.
Figure 6:
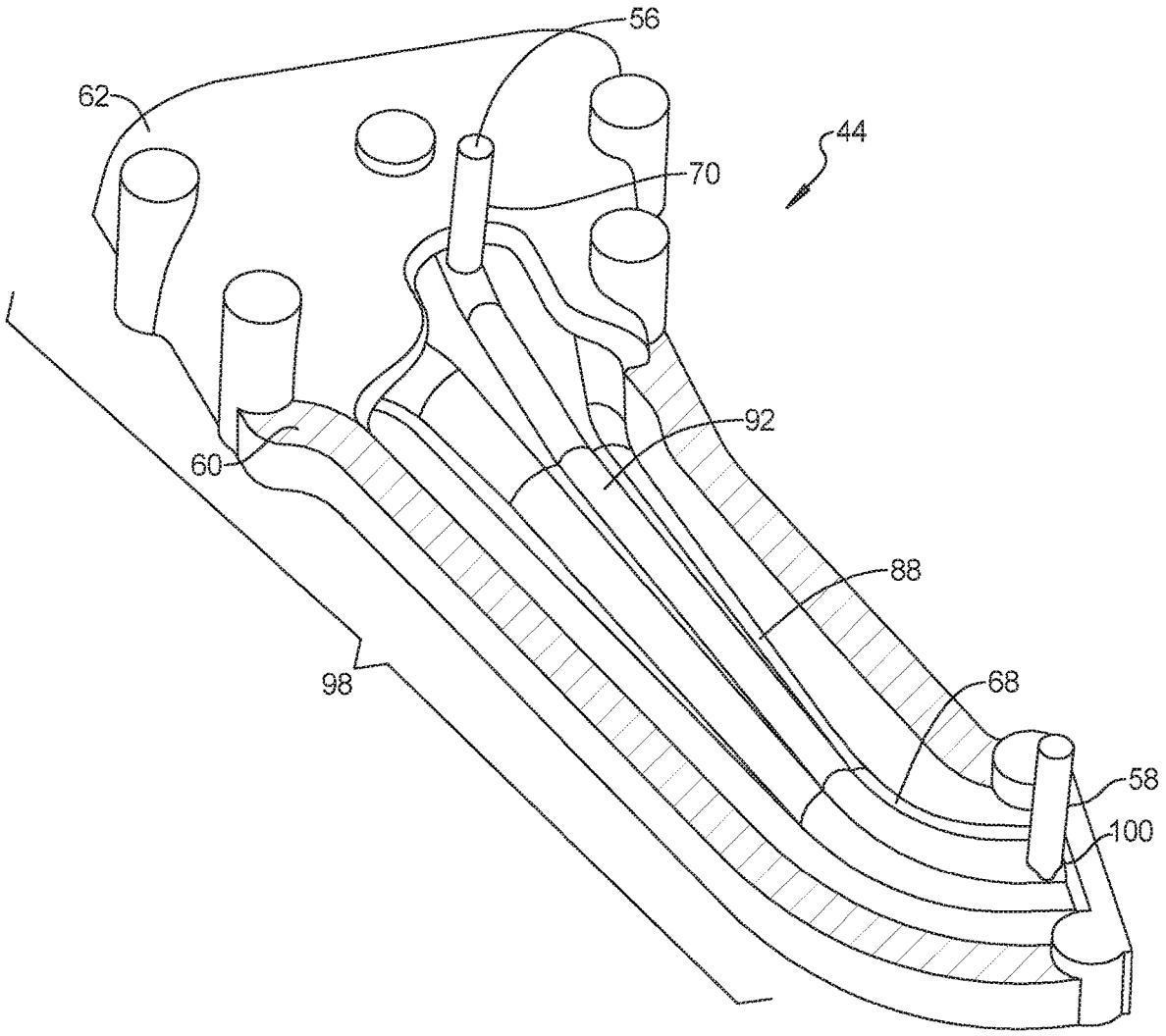
FIG. 6 is a partial cross sectional perspective view of a sprue of the present disclosure.

Referring to FIG. 3 and again to FIG. 2, the sprue 44 includes a first half 60 and a second half 62. A flow passage first portion 64 is provided through the first half 60 which communicates with a flow passage second portion 66 created in the second half 62 when the two halves are joined. A coolant jacket 68 defining a cavity is created in the second half 62 which extends for a substantial length of the second half 62. The coolant jacket 68 is connected at opposite ends to the coolant supply line 56 and the coolant return line 58 for the coolant source 54. An inlet coolant connection 70 connects the coolant jacket 68 to the coolant supply line 56 and thereby to the coolant source 54. A similar outlet coolant connection shown and described in reference to FIG. 6 connects the coolant jacket 68 to the coolant return line 58 to return coolant flow to the coolant source 54.

A heat transfer wall defining a shell 72 of the second half 62 separates the flow passage second portion 66 from the coolant jacket 68. The amount of heat transfer available to cool metal in the flow passage second portion 66 is controlled by a wall thickness 74 of the shell 72. According to several aspects, the wall thickness 74 ranges between approximately 3 mm up to approximately 5 mm, with a maximum of approximately 6 mm. The wall thickness 74 is selected to optimize gating solidification. The wall thickness 74 minimum of 3 mm prevents solidification from occurring too slowly, defined as exceeding the 240 second total time period allowed for solidification, and also minimizes thermal distortion of the sprue 44 at the coolant jacket 68. The wall thickness 74 maximum of 6 mm prevents solidification from occurring too quickly, defined as solidification of the metal in the mold occurring prior to solidification in the gating section 50 or the feed portion 40. Coolant flow to the coolant jacket 68 is initiated after molten metal pour is completed and continues for approximately 20 seconds to fully solidify material in the sprue 44. Material in the feed portion 40 is the last material to solidify in the molding system 34, therefore providing coolant flow to the sprue 44 ensures the material solidifies and cools to approximately 300 degrees Centigrade to allow mold opening and casting removal.

Figure 3:
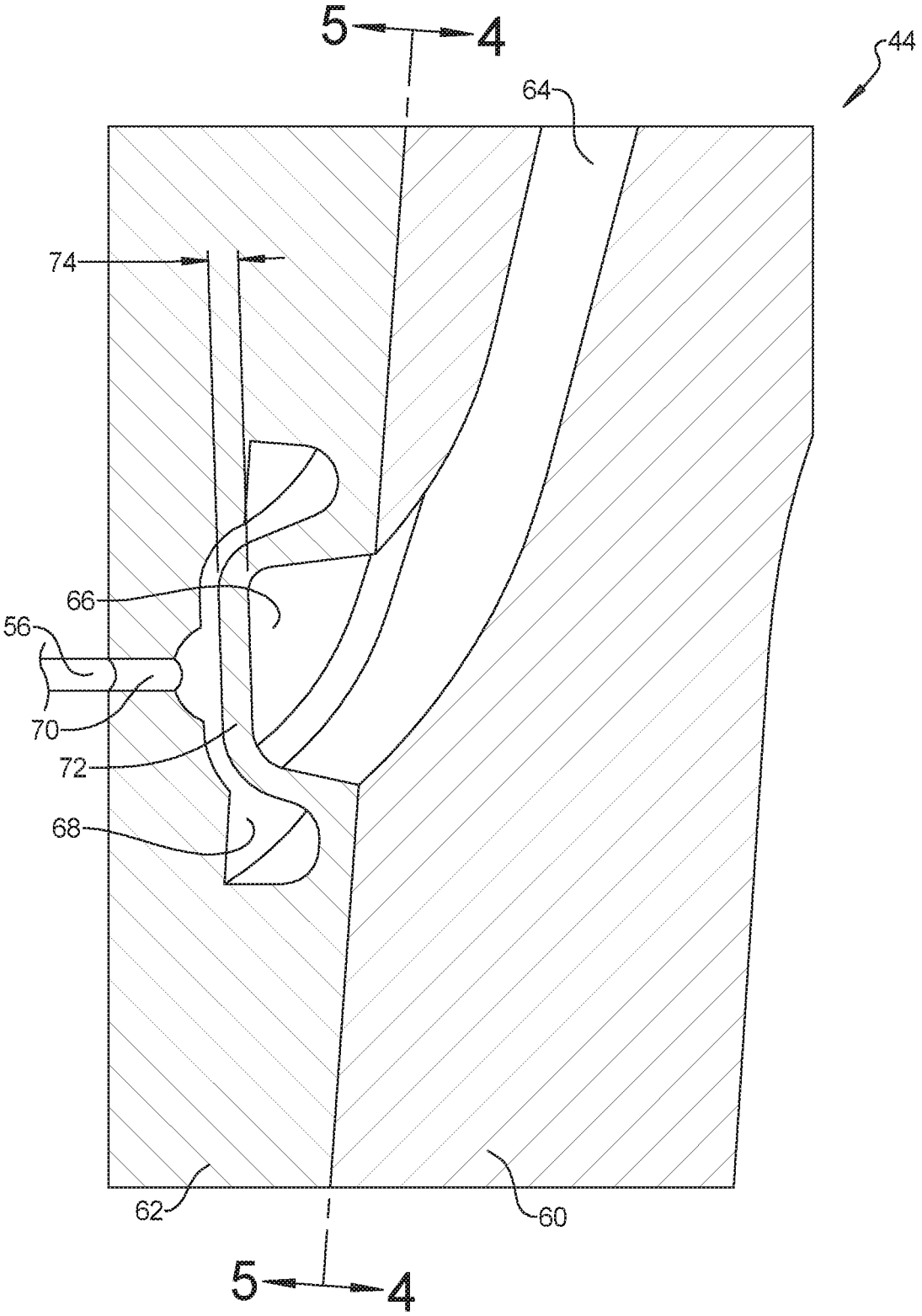
FIG. 3 is a cross sectional front elevational view taken at section 3 of FIG. 2.

Referring to FIG. 4 and again to FIGS. 2 through 3, the first half 60 of the sprue 44 includes a body 76 having the flow passage first portion 64 created therethrough. A wide mouth inlet 78 of the flow passage first portion 64 transitions into a central passage 80 having a smaller cross section than the inlet 78. A bend 82 changes flow direction approximately 90 degrees from the central passage 80 and defines an outlet of the flow passage first portion 64. The choke point 52 defines a minimum passage size of the central passage 80, combined with a corresponding passage size of the second half 62, and is located upstream of the bend 82. The choke point 52 is sized to limit a mass flow rate of the molten metal to provide a mold fill time of approximately 10 to 11 seconds. The choke point 52 heats up rapidly and helps control gating and sprue solidification times, which allows directional solidification into the sprue 44.

Figure 5:
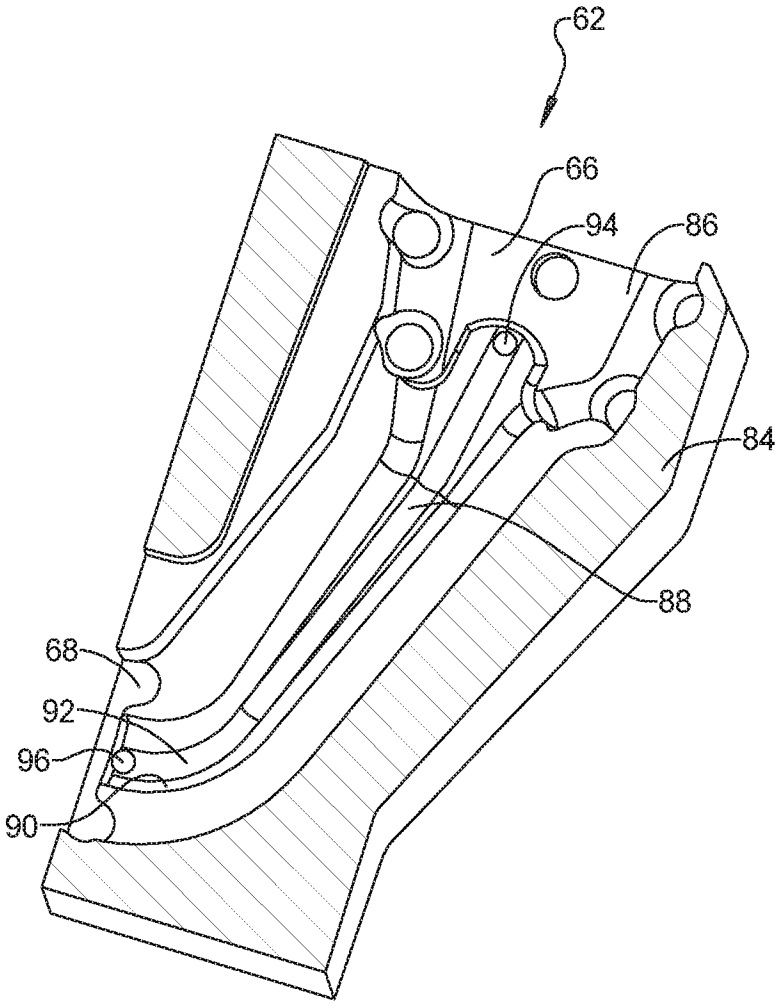
FIG. 5 is a cross sectional side elevational view taken at section 4 of FIG. 3.
Figure 4:
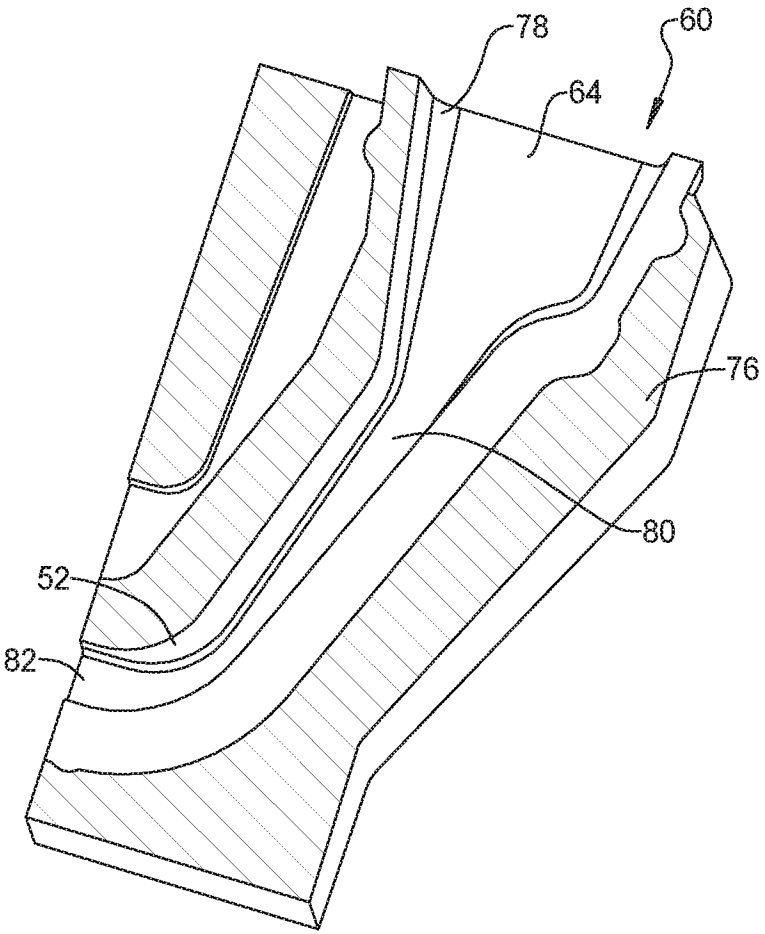
FIG. 4 is a cross sectional side elevational view taken at section 4 of FIG. 3.

Referring to FIG. 5 and again to FIGS. 2 through 4, the second half 62 of the sprue 44 includes a body 84 having the flow passage second portion 66 created therethrough. A wide mouth inlet 86 of the flow passage second portion 66 transitions into a central passage 88 having a smaller cross section than the inlet 86. A bend 90 changes flow direction approximately 90 degrees from the central passage 88 and defines an outlet of the flow passage second portion 66. The coolant jacket 68 extends substantially an entire length of the flow passage second portion 66 and includes a raised tube portion 92 throughout, which delivers coolant flow between a coolant inlet connection 94 and a coolant discharge connection 96. The coolant discharge connection 96 is preferably provided at a lower position or bottom of the sprue 44, and if the coolant is water therefore provides for coolant drainage out of the sprue 44.

Referring to FIG. 6 and again to FIGS. 2 through 5, the coolant jacket 68 extends for substantially an entire length 98 of the sprue 44, therefore substantially the entire sprue 44 is cooled by coolant flow. The coolant (air or water) enters the inlet coolant connection 70 via the coolant supply line 56, traverses the coolant jacket 68 including through the raised tube portion 92, and exits at an outlet coolant connection 100 into the coolant return line 58 for return to the coolant source 54.

A system and method for casting metal using a semi-permanent mold connected to a gating section and a feed portion of the present disclosure offers several advantages. These include the elimination of a riser produced in common semi-permanent molding operations which therefore minimizes solidification shrinkage porosity, provision of a flow choke point in the feed section of the mold system to control molten metal flow rates, predetermining sprue and gating section wall thickness to achieve solidification cooling rates and times, thermally managing the design of the sprue section of the molding system to be the last section to cool to the solidification state thereby allowing directional solidification into the sprue, and provision of a coolant jacket and a coolant flow into the coolant jacket of the sprue to force cool the sprue at the end of the mold cooling time period prior to opening the mold.

While exemplary aluminum alloy materials and material melt temperatures are provided herein for examples, the present disclosure and the molding system 34 are not limited to these materials or temperatures, and the molding system 34 can be used for other metals and metal forming temperatures. The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method for casting metal using a semi-permanent mold connected to a gating section and a feed portion, the method comprising:

connecting the gating section for fluid communication with the semi-permanent mold;

incorporating a force cooled sprue in the feed portion;

preforming a coolant jacket in the sprue about a shell;

connecting a coolant source to the coolant jacket extending the coolant jacket for a substantial length of the sprue;

pouring a metal in a molten state into the feed portion for gravity induced flow into each of the gating section and the semi-permanent mold; and during a predetermined time for the metal to cool to a solid state in the mold, initiating flow of a coolant into the coolant jacket to cool the metal in the sprue before opening the mold.

2. The method for casting metal of claim 1, further including:

controlling the semi-permanent mold to approximately 300 degrees Centigrade prior to the pouring step; and continuing the flow of the coolant until the metal in the sprue cools to approximately 450 degrees Centigrade.

3. The method for casting metal of claim 1, further including providing a choke point in the sprue to predetermine a fill time of the mold of approximately 11 seconds.

4. The method for casting metal of claim 1, further including continuing the flow of the coolant for approximately 20 seconds prior to opening the mold.

5. The method for casting metal of claim 1, further including providing a predetermined wall thickness in the sprue in a shell between a coolant jacket and a passageway of the sprue, the passageway providing for through flow of the metal in the molten state, the predetermined wall thickness ranging between a minimum wall thickness and a maximum wall thickness.

6. The method for casting metal of claim 5, further including selecting the minimum wall thickness as 3 mm to prevent solidification from occurring too slowly, defined as exceeding 240 seconds as the predetermined time for the metal to cool to the solid state in the mold.

7. The method for casting metal of claim 5, further including selecting the maximum wall thickness as 6 mm to prevent solidification from occurring too quickly, defined as solidification of the metal in the mold occurring prior to solidification of the metal in the feed portion.

8. The method for casting metal of claim 1, further including:

connecting the coolant source to an input connection of the coolant jacket; and fixing an output connection of the coolant jacket to a coolant return line to return the coolant to the coolant source.

* * * * *